US009693616B2

(12) United States Patent
Sakuma et al.

(10) Patent No.: US 9,693,616 B2
(45) Date of Patent: Jul. 4, 2017

(54) HAIR DRYER

(71) Applicant: Nidec Corporation, Kyoto (JP)

(72) Inventors: Yuuichi Sakuma, Kyoto (JP); Jun Murakami, Kyoto (JP); Takamasa Yamashita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 14/956,631

(22) Filed: Dec. 2, 2015

(65) Prior Publication Data

US 2016/0213122 A1 Jul. 28, 2016

Related U.S. Application Data

(60) Provisional application No. 62/106,914, filed on Jan. 23, 2015.

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12
USPC ..... 34/97; 392/384
See application file for complete search history.

(56) References Cited

U.S. PATENT DOCUMENTS 2,091,510 A * 8/1937 Lanz ..... H02K 7/145 310/50
2,481,407 A * 9/1949 Fluegel ..... A45D 20/46 34/82
4,794,225 A * 12/1988 Maese ..... F24H 3/0423 34/97
6,212,790 B1 * 4/2001 Stetson ..... A45D 20/12 34/103
8,256,132 B2 * 9/2012 Gaillard ..... A45D 20/12 132/221
8,307,948 B2 * 11/2012 Parodi ..... A45D 20/12 181/212
8,893,400 B2 * 11/2014 Carme ..... A45D 20/12 132/115
D726,960 S * 4/2015 Fernandes da Costa ..... D28/18
9,173,468 B2 * 11/2015 Moloney ..... A45D 20/10
9,282,800 B2 * 3/2016 Courtney ..... A45D 20/04
2016/0213123 A1 * 7/2016 Sakuma ..... A45D 20/12
(Continued)

FOREIGN PATENT DOCUMENTS

DE 4100509 A1 * 7/1992 ..... A45D 20/122
EP 2497385 A1 * 9/2012 ..... A45D 20/12
EP 3047751 A1 * 7/2016 ..... A45D 20/12
(Continued)

*Primary Examiner* — Stephen M Gravini
(74) *Attorney, Agent, or Firm* — Keating & Bennett, LLP

(57) ABSTRACT

A hair dryer includes a fan motor, a heater unit, and a body case arranged to cover the fan motor and the heater unit. The fan motor includes an impeller arranged to rotate about a central axis, and a motor arranged to rotate the impeller. The body case includes an intake case portion including an air inlet, and a discharge case portion including an air outlet. Inside the body case, an inner tubular case portion arranged to extend along an inside surface of the body case is accommodated. A silencing space is defined between the inside surface of the body case and the inner tubular case portion. An opening portion is defined to join the silencing space and an interior space of the body case to each other.

19 Claims, 7 Drawing Sheets

(56) References Cited

U.S. PATENT DOCUMENTS

| | | | | |
|---|---|---|---|---|
| 2016/0324292 | A1* | 11/2016 | Depoyian | A45D 20/50 |
| 2016/0368996 | A1* | 12/2016 | Buckanovich | C07K 16/2869 |

FOREIGN PATENT DOCUMENTS

| | | | | | |
|---|---|---|---|---|---|
| JP | 5-228013 | A | | 9/1993 | |
| JP | 07155219 | A | * | 6/1995 | |
| KR | 101508324 | B1 | * | 4/2015 | |
| WO | WO 2004043199 | A1 | * | 5/2004 | A45D 20/10 |

* cited by examiner

HAIR DRYER

BACKGROUND OF THE INVENTION

1. Field of the Invention

The present invention relates to a hair dryer.

2. Description of the Related Art

When a hair dryer blows air, noise is typically caused by air-column resonance or the like. A technique of reducing noise of a hair dryer is described in, for example, JP-A 1993-228013. A hair dryer utilizing the principle of Helmholtz resonators is described in JP-A 1993-228013. The hair dryer is tubular and contains a motor fitted with a blower fan, and a heater to heat air being blown. The hair dryer includes a case and a resonator. In the case, a plurality of holes are made at positions at which an axial distribution of sound pressure of standing-wave noise due to air-column resonance exhibits high levels. The resonator is attached to cover the holes of the case. That is, a resonance space is defined between the case and the resonator, in other words, inside the hair dryer.

As described above, JP-A 1993-228013 describes a technique of providing the resonator for the plurality of holes to absorb and attenuate sound at specific frequencies to reduce sound pressure.

According to a structure depicted in FIG. 1 of JP-A 1993-228013, however, resonance spaces corresponding to the respective holes are not finely partitioned off. Therefore, noise cannot be reflected inside each of the resonance spaces corresponding to the respective holes, and sufficient effects of noise reduction by Helmholtz resonators cannot be achieved. Meanwhile, according to a structure depicted in FIG. 4 of JP-A 1993-228013, cases to define resonance spaces are provided separately for different sets of holes. Therefore, effects of the Helmholtz resonators may be achieved. However, because the number of cases to define the resonance spaces is increased, the number of parts increases. This results in an increased number of steps of a process of manufacturing the hair dryer, leading to an increased production cost of the hair dryer. Further, an external surface of the hair dryer becomes uneven, spoiling the aesthetic appearance of the hair dryer. Furthermore, a method for ensuring close adhesion of the cases is not disclosed in JP-A 1993-228013.

SUMMARY OF THE INVENTION

According to a preferred embodiment of the present invention, there is provided a hair dryer arranged to send air forward along a central axis extending in a front-rear direction, the hair dryer include a fan motor; a heater unit; and a hollow tubular body case arranged to cover the fan motor and the heater unit, and arranged to extend in the front-rear direction around the central axis to define an interior space. The fan motor includes an impeller arranged to rotate about the central axis, and a motor arranged to rotate the impeller. The body case includes an intake case portion including an air inlet, and a discharge case portion including an air outlet. The body case has an inner tubular case portion accommodated therein, the inner tubular case portion being arranged to extend along an inside surface of the body case. The inside surface of the body case and the inner tubular case portion are arranged to together define a silencing space therebetween. An opening portion is defined between the inner tubular case portion and the body case or in the inner tubular case portion to join the silencing space and the interior space to each other.

The above preferred embodiment of the present invention enables a Helmholtz resonator which reduces noise at a specific frequency to be defined inside the hair dryer by appropriately designing the cross-sectional area of the opening portion and the volume of the silencing space. In relation to sound waves of noise, such as an air-column resonance and the like, caused by fluctuations in air pressure, the Helmholtz resonator absorbs the fluctuations in air pressure to reduce noise of the hair dryer.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

It is assumed herein that a direction along a central axis of a motor is defined as a front-rear direction, and that a side on which an air outlet is defined and a side on which an air inlet is defined are defined as a front side and a rear side, respectively. The shape of each member or portion and relative positions of different members or portions will be described based on the above assumptions. It should be noted, however, that the above definitions of the front-rear direction and the front and rear sides are not meant to restrict in any way the orientation of a hair dryer according to any preferred embodiment of the present invention when in use. It is also assumed herein that directions parallel to or substantially parallel to the central axis of the motor are referred to by the term "axial direction", "axial", or "axially", that radial directions centered on the central axis are simply referred to by the term "radial direction", "radial", or "radially", and that a circumferential direction about the central axis is simply referred to by the term "circumferential direction", "circumferential", or "circumferentially". The "cross-sectional area" of an opening or a gap portion refers to a cross-sectional area thereof as measured on a plane perpendicular to the central axis.

Figure 1:
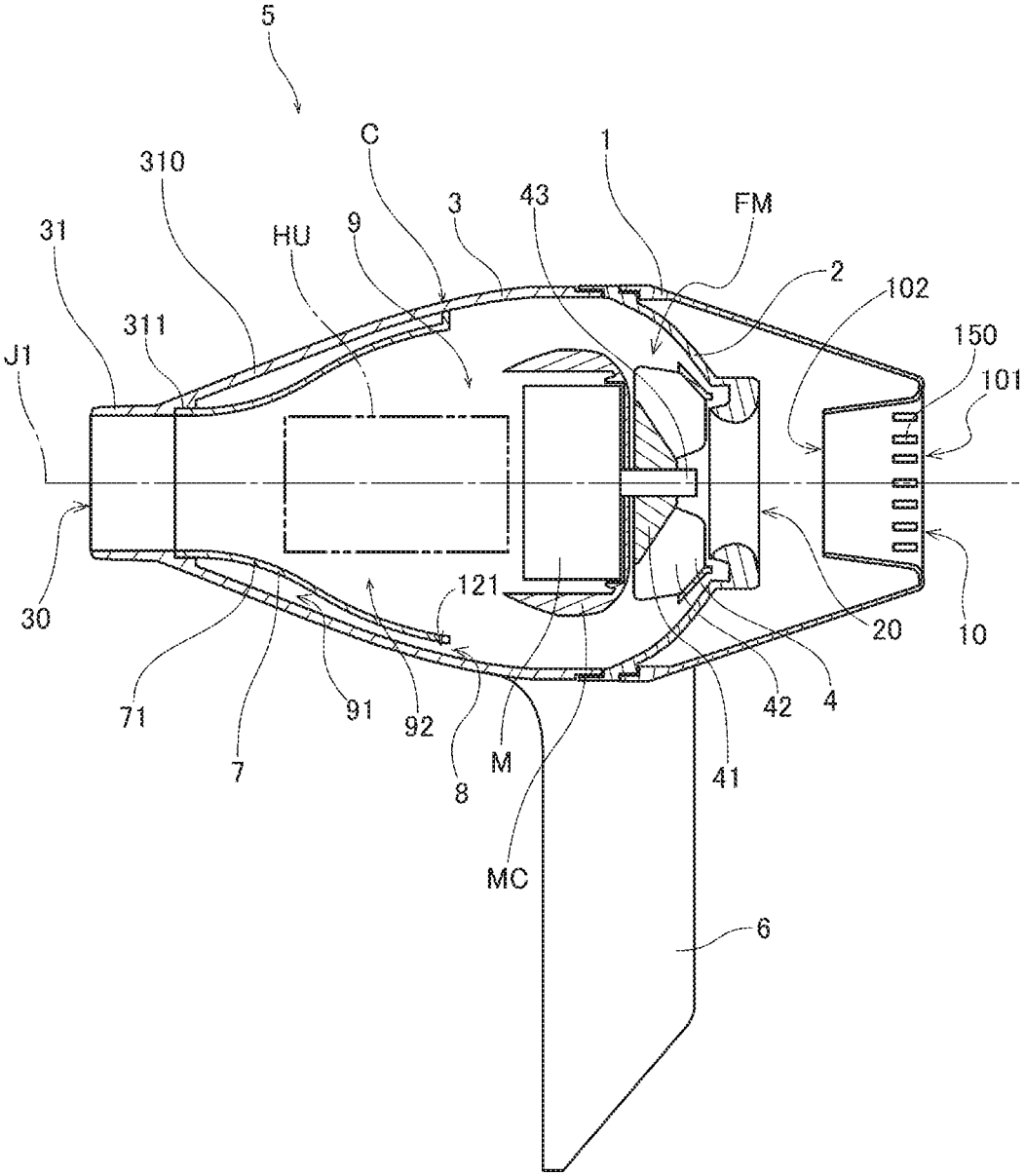
FIG. 1 is a cross-sectional view of a hair dryer according to a preferred embodiment of the present invention.

FIG. 1 is a vertical cross-sectional view of a hair dryer 5 according to an exemplary preferred embodiment of the present invention. The hair dryer 5 is an apparatus arranged to send air forward by rotating an impeller 4 through power of a motor M. The hair dryer 5 is used as, for example, a household hair drier or a hair drier for professional use to dry hair.

Referring to FIG. 1, the hair dryer 5 according to the present preferred embodiment includes a fan motor FM, a heater unit HU, a body case C, and a handle portion 6. The fan motor FM includes the impeller 4, which is arranged to rotate about a central axis J1, the motor M, which is arranged to rotate the impeller 4, and a motor case MC arranged to hold the motor M. The fan motor FM according to the present preferred embodiment is a centrifugal fan.

The impeller 4 is arranged to generate an air flow by rotating about the central axis J1. The impeller 4 is arranged radially inside of the body case C. Referring to FIG. 1, the impeller 4 includes a base portion 41 arranged in a center thereof, and a plurality of blades 42 arranged to extend radially outward from the base portion 41. The base portion 41 is fixed to a shaft 43 of the motor M, which will be described below. The blades 42 are arranged in a circumferential direction on a radially outer side of the base portion 41.

The base portion 41 and the blades 42 are integrally defined by a resin injection molding process, for example. Note that the impeller 4 may alternatively be defined by a plurality of members. For example, the base portion 41 and the blades 42 may be separate members. Also note that the impeller 4 may alternatively be made of a material other than resins.

The motor M is a power source to supply power for rotation to the impeller 4. In the hair dryer 5, the motor M is arranged forward of the impeller 4. Note that the motor M may alternatively be arranged rearward of the impeller 4. The motor M includes the shaft 43, which is arranged to extend along the central axis J1. Once the motor M is driven, magnetic flux of coils inside the motor M and magnetic flux of a magnet(s) inside the motor M interact to produce a circumferential torque. As a result, the shaft 43 of the motor M is caused to rotate about the central axis J1.

A brushless DC motor, for example, is used as the motor M. The brushless DC motor has a longer life than a comparable brushed motor because the brushless DC motor is free from a deterioration in performance caused by a wear of a brush. In addition, it is easier to change the speed of the brushless DC motor than the speed of an AC motor, and it is also easier to reduce the power consumption of the brushless DC motor than the power consumption of the AC motor. Note, however, that a brushed motor or an AC motor may be used instead of the brushless DC motor.

The motor case MC is a member arranged to hold the motor M in front of the impeller 4. The motor case MC is arranged to surround the motor M. An outside surface of the motor M is arranged to be at least partly in contact with an inside surface of the motor case MC. The motor M is thus positioned inside of the motor case MC. The air flow generated by the impeller 4 passes through a space radially outside of the motor case MC. An outside surface of the motor case MC is arranged to once increase in a diameter and then decrease in the diameter as it extends forward from a rear end thereof. That is, the outside surface of the motor case MC is curved to extend along an opposed portion of an inside surface of the body case C. This increases efficiency with which the air flow generated by the impeller 4 is sent forward around the motor case MC.

The heater unit HU is arranged forward of the motor M inside the body case C. The heater unit HU includes, for example, a heating wire, such as a nichrome wire, which generates heat when energized, and a support plate arranged to support the heating wire. In FIG. 1, the heater unit HU is represented by a chain double-dashed line. A rear end of the heater unit HU is arranged rearward of a front end of the motor case MC. The heater unit HU is thus efficiently disposed in the hair dryer 5 utilizing a space inside of the motor case MC.

The body case C is a hollow tubular case arranged to extend in the front-rear direction around the central axis J1 to define an interior space 9. A resin, for example, is used as a material of the body case C. The fan motor FM and the heater unit HU are accommodated inside the body case C.

The body case C includes an intake case portion 1, a discharge case portion 3, and an admission case portion 2. An inner tubular case portion 7 is accommodated inside the body case C. The intake case portion 1 includes an air inlet 10 through which air is sucked from an external space. The discharge case portion 3 includes an air outlet 30 through which the air is discharged to the external space. The admission case portion 2 is arranged between the discharge case portion 3 and the intake case portion 1. In addition, the admission case portion 2 includes an admission inlet 20 arranged between the air inlet 10 and the air outlet 30. The admission inlet 20 is arranged to pass through the admission case portion 2 in a direction parallel to the central axis J1. The impeller 4 is arranged radially inside of the admission case portion 2. An inside surface of the admission case portion 2 is arranged in proximity to an outer end portion of the impeller 4. This contributes to preventing a backflow of gas through a gap between the inside surface of the admission case portion 2 and the impeller 4.

The air inlet 10 is defined inside of a tubular portion of the intake case portion 1 which extends forward from a rear end portion of the intake case portion 1 toward the admission inlet 20. The air inlet 10 includes a first opening 101, which is a rear opening thereof, and a second opening 102, which is a front opening thereof. The first opening 101 and the second opening 102 are through holes, and are arranged to join the external space, i.e., a space outside of the body case C, and the interior space 9, i.e., a space inside of the body case C, to each other. In the present preferred embodiment, an impeller guard portion 150 is provided in the air inlet 10 to prevent a human finger or the like from touching the impeller 4.

The inner tubular case portion 7 is arranged to extend in an axial direction along the inside surface of the body case C. Then, a silencing space 91 is defined between the inside surface of the body case C and the inner tubular case portion 7. The silencing space 91 and the interior space 9 are joined to each other through an opening portion 8. The opening portion 8 is defined between the inner tubular case portion 7 and the body case C or in the inner tubular case portion 7. A Helmholtz resonator can be defined by the silencing space 91 and the opening portion 8. Because the Helmholtz resonator is defined inside of the body case C of the hair dryer 5, aesthetic appearance of the hair dryer 5 is not spoiled.

The handle portion 6 is a portion to be held by a user of the hair dryer 5 when the user uses the hair dryer 5. The handle portion 6 is arranged to extend radially outward from a region including or near a boundary between the intake case portion 1 and the admission case portion 2 and/or a boundary between the admission case portion 2 and the discharge case portion 3. A switch(es) (not shown) is provided in the handle portion 6 to allow the user to turn on and off the hair dryer 5 or adjust the power of the hair dryer 5. In the present preferred embodiment, the intake case portion 1, the discharge case portion 3, and the handle portion 6 are defined by separate members. Note, however, that the intake case portion 1, the discharge case portion 3, and the handle portion 6 may alternatively be defined by a single monolithic member.

Once the motor M is driven, the impeller 4 is caused to rotate. As a result, air flows into the air inlet 10 from the space outside of the body case C. The air, which has flowed into the body case C, is guided to the admission inlet 20. Thereafter, the air is heated by the heater unit HU, which is arranged inside the discharge case portion 3. The air is then discharged out of the body case C through the air outlet 30.

Figure 2:
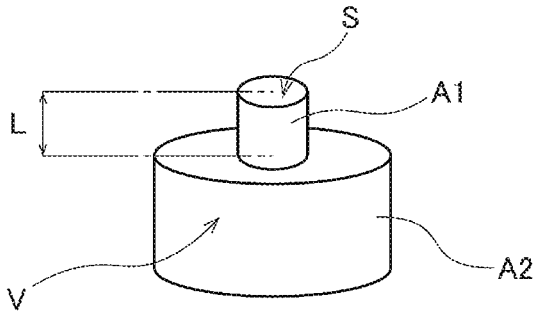
FIG. 2 is a schematic diagram of a Helmholtz resonator.

At this time, inside the hair dryer 5, fluctuations in air pressure cause noise, such as, for example, an air-column resonance. The Helmholtz resonator reduces noise in a specific frequency band by absorbing the fluctuations in air pressure. FIG. 2 is a schematic diagram of the Helmholtz resonator. Referring to FIG. 2, the Helmholtz resonator is made up of a neck tube A1 and a volume portion A2. A resonance frequency F of the Helmholtz resonator is given by the following equation:

$$F=C/2\pi\times\sqrt{(S/VL)}. \quad \text{Eq. 1}$$

In the above equation, C is the speed of sound, S is the cross-sectional area of the neck tube A1, L is the length (with acoustic correction) of the neck tube A1, and V is the volume of the volume portion A2. In the present preferred embodiment, S corresponds to the cross-sectional area of the opening portion 8, L corresponds to the length of the opening portion 8, and V corresponds to the volume of the silencing space 91. Using the above equation, the Helmholtz resonator can be designed in accordance with frequencies of noise to be reduced.

Thus, noise at any frequency can be reduced by appropriately designing the cross-sectional area S of the opening portion 8 and the volume V of the silencing space 91. Noise at any frequency, such as, for example, 400 Hz or 1000 Hz, can thus be reduced. Accordingly, it is possible to reduce frequency components of high-level noise caused by air-column resonance when the hair dryer 5 is in operation. Therefore, it is possible to reduce propagation of noise caused inside the hair dryer 5 to the external space, reducing noise of the hair dryer 5.

In the present preferred embodiment, the inner tubular case portion 7 is accommodated inside the discharge case portion 3. In addition, the inner tubular case portion 7 includes a tubular portion 71 arranged to extend in the axial direction along an inside surface of the discharge case portion 3. A discharge space 92 through which air to be discharged passes is defined inside the discharge case portion 3. Meanwhile, the silencing space 91 is defined between the inside surface of the discharge case portion 3 and the inner tubular case portion 7. The silencing space 91 is joined to the discharge space 92 through the opening portion 8.

The Helmholtz resonator can thus be defined inside the discharge case portion 3. In particular, the discharge space 92 is located downstream of the impeller 4 with respect to the air flow caused by the rotation of the impeller 4. Accordingly, fluctuations in air pressure constantly occur in the discharge space 92. In the present preferred embodiment, the opening portion 8 and the silencing space 91 combine to act as the Helmholtz resonator. The fluctuations in air pressure in the discharge space 92 are absorbed thereby. As a result, noise that occurs when the hair dryer is in operation is reduced.

The air-column resonance is a natural fluctuation in air pressure caused in the tubular interior space 9 by fluctuations in air pressure, fluctuations in flow velocity, turbulence, and so on in the interior space 9, and primarily occurs inside the discharge case portion 3. Fluctuations in air pressure occur inside the intake case portion 1 as well. Antinodes of sound waves of noise typically occur in the axial direction inside the discharge case portion 3. However, if sound waves of noise caused by the air-column resonance have a high frequency, antinodes of these sound waves may occur in a radial direction as well inside the intake case portion 1 and the discharge case portion 3. In the present preferred embodiment, a rear end portion of the inner tubular case portion 7 is arranged forward of the impeller 4. This allows the opening portion 8 to be arranged at an antinode of a sound wave of noise the antinodes of which occur in the axial direction inside the discharge case portion 3. In addition, the rear end portion of the inner tubular case portion 7 is arranged radially outward of the impeller 4. This allows the opening portion 8 to be arranged at an antinode of a sound wave of noise the antinodes of which occur in the radial direction inside the discharge case portion 3. Accordingly, the noise caused by the air-column resonance can be effectively reduced.

In the present preferred embodiment, the discharge case portion 3 includes a case tubular portion 310 arranged to decrease in a diameter as it extends toward the air outlet 30 away from the air inlet 10, and a nozzle portion 31 arranged to extend forward from a front end of the case tubular portion 310. The tubular portion 71 is located radially inside of the case tubular portion 310. Thus, the tubular portion 71 is arranged radially inside of the case tubular portion 310, which is conical and is arranged to decrease in the diameter in a forward direction. Accordingly, when the discharge case portion 3 and the inner tubular case portion 7 are fitted to each other, the inner tubular case portion 7 can be easily positioned by inserting the inner tubular case portion 7 along the inside surface of the discharge case portion 3. This facilitates fitting of the discharge case portion 3 and the inner tubular case portion 7 to each other.

In addition, the tubular portion 71 is arranged to extend along the inside surface of the case tubular portion 310 such that a cross-sectional area of a radial clearance space between the case tubular portion 310 and the tubular portion 71 gradually increases in the forward direction toward the air outlet 30. The volume V of the silencing space 91 can thus be varied by appropriately designing the inner tubular case portion 7. A target frequency range of the Helmholtz resonator can thus be varied. Note that the external shape of the discharge case portion 3 affects the aesthetic appearance of the hair dryer 5. Therefore, from the viewpoint of the aesthetic appearance of the hair dryer 5, the external shape of the discharge case portion 3 cannot be freely designed. In the present preferred embodiment, the volume of the silencing space 91 is varied by curving the tubular portion 71 of the inner tubular case portion 7 radially inward significantly compared to the discharge case portion 3 without allowing the discharge case portion 3 to have a large curvature. This makes it possible to properly set the target frequency range of the Helmholtz resonator without spoiling the aesthetic appearance of the hair dryer 5.

In addition, in the present preferred embodiment, the discharge case portion 3 includes a shoulder portion 311. The shoulder portion 311 is defined at an inside surface of a portion of the discharge case portion 3 at a junction between the case tubular portion 310 and the nozzle portion 31. The shoulder portion 311 includes an annular surface facing rearward, and an annular surface facing radially inward. The shoulder portion 311 is arranged near a front end of the tubular portion 71, and is arranged to be in axial and radial contact with the inner tubular case portion 7. The shoulder portion 311 is arranged to have an inside diameter greater than an inside diameter of the nozzle portion 31 and smaller than an inside diameter of the case tubular portion 310. An outside surface of a front end portion of the inner tubular case portion 7 is fitted to an inside surface of the shoulder portion 311.

Thus, the fitting of the discharge case portion 3 and the inner tubular case portion 7 to each other is accomplished easily. In addition, an inside surface of the nozzle portion 31 and an inside surface of the tubular portion 71 are preferably arranged to have the same diameter at a radially inner end of the shoulder portion 311. This eliminates a shoulder at a junction between the inside surface of the nozzle portion 31 and an inside surface of the inner tubular case portion 7. This contributes to reducing air passage resistance in the discharge space 92. In addition, occurrence of eddies caused by an air flow striking the nozzle portion 31 can be reduced. This leads to reduced noise of the hair dryer 5.

Next, the structure of the inner tubular case portion 7 will be further described below.

Figure 3:
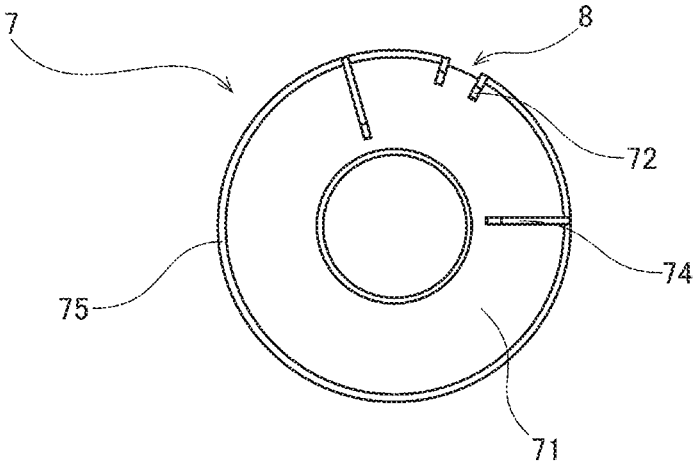
FIG. 3 is a front view of an inner tubular case portion according to a preferred embodiment of the present invention.
Figure 4:
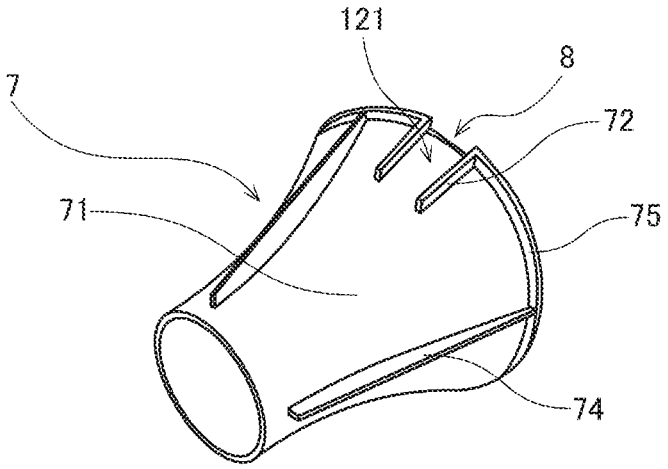
FIG. 4 is a perspective view of the inner tubular case portion according to a preferred embodiment of the present invention.
Figure 5:
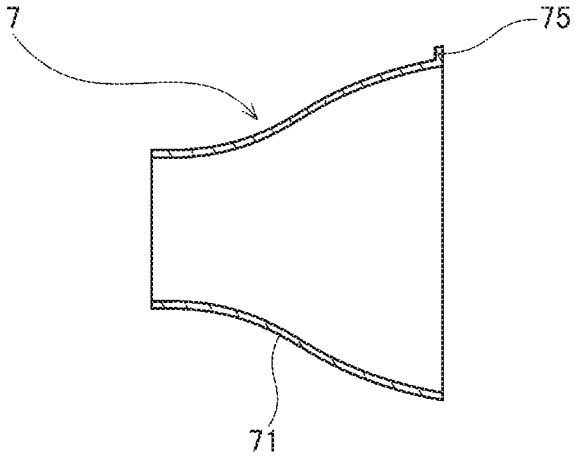
FIG. 5 is a vertical cross-sectional view of the inner tubular case portion according to a preferred embodiment of the present invention.

FIG. 3 is a front view of the inner tubular case portion 7 according to a preferred embodiment of the present invention. FIG. 4 is a perspective view of the inner tubular case portion 7 according to a preferred embodiment of the present invention. FIG. 5 is a vertical cross-sectional view of the inner tubular case portion 7 according to a preferred embodiment of the present invention.

In the present preferred embodiment, the inner tubular case portion 7 includes a substantially annular flange portion 75 arranged to extend from a rear end portion thereof toward the inside surface of the discharge case portion 3. The opening portion 8 is defined in the flange portion 75, and is arranged to pass through the flange portion 75 in the axial direction. This structure makes it easy to define the opening portion 8 in any desired size. Accordingly, it is easy to vary the target frequency range of the Helmholtz resonator by adjusting the circumferential extent of the opening portion 8. Moreover, it is easy to define the opening portion 8 when the inner tubular case portion 7 is molded of a resin.

An outside surface of the flange portion 75 is arranged to be in contact with the inside surface of the discharge case portion 3 over the entire circumferential extent except at the opening portion 8. This allows the discharge case portion 3 and the inner tubular case portion 7 to be fixed to each other. Moreover, a gap between the discharge case portion 3 and the inner tubular case portion 7 can be eliminated to increase an effect of the Helmholtz resonator. Note that an adhesive or the like may be arranged between the outside surface of the flange portion 75 and the inside surface of the discharge case portion 3.

In addition, the inner tubular case portion 7 includes two first side wall portions 72, which are two plate-shaped portions, arranged at an outside surface of the inner tubular case portion 7. The first side wall portions 72 are arranged to extend forward from both circumferential sides of the opening portion 8 between the inside surface of the discharge case portion 3 and the outside surface of the inner tubular case portion 7. In addition, each first side wall portion 72 is arranged to extend from the outside surface of the inner tubular case portion 7 toward the inside surface of the discharge case portion 3. A radially outer edge of the first side wall portion 72 is arranged to be in contact with the inside surface of the discharge case portion 3. Note that the first side wall portions may alternatively be arranged in the discharge case portion. In this case, each first side wall portion may be arranged to extend radially inward from the inside surface of the discharge case portion to come into contact with the outside surface of the inner tubular case portion.

A gap portion 121 is defined between the first side wall portions 72, the inside surface of the discharge case portion 3, and the outside surface of the inner tubular case portion 7. Here, a cross-sectional area of the gap portion 121 perpendicular to the central axis J1 corresponds to the cross-sectional area S of the neck tube of the Helmholtz resonator. The axial dimension of each first side wall portion 72 corresponds to the length L of the neck tube of the Helmholtz resonator. The volume of the silencing space 91, which is a space surrounded by the inside surface of the discharge case portion 3 and the outside surface of the inner tubular case portion 7, and partitioning portions 74 described below but excluding the gap portion 121, corresponds to the volume V of the volume portion of the Helmholtz resonator.

Accordingly, to vary the target frequency range of the Helmholtz resonator, it is necessary to vary the volume of the silencing space 91 and/or the cross-sectional area of the opening portion 8. However, a change in the volume of the discharge space 92, through which air flows, affects the air volume, static pressure, and so on of the hair dryer 5. Thus, provision of the first side wall portions 72 as in the present preferred embodiment makes it possible to appropriately design the cross-sectional area S of the neck tube and the length L of the neck tube. This makes it possible to vary the target frequency range of the Helmholtz resonator without changing the volume of the discharge space 92. This provides increased flexibility in designing the discharge space 92 in the hair dryer 5 provided with the Helmholtz resonator.

The two plate-shaped portions defining the first side wall portions 72 are preferably arranged to extend in parallel with one plane including the central axis J1. This makes it easy to remove the inner tubular case portion 7 from a mold when the inner tubular case portion 7 including the first side wall portions 72 is molded of the resin. This makes it easy to manufacture the inner tubular case portion 7.

In addition, according to the present preferred embodiment, the gap portion 121 is arranged to have an equal opening area at a rear end and a front end thereof. As a rule, the Helmholtz resonator absorbs and reduces the fluctuations in air pressure in the discharge space 92 by allowing air inside the gap portion 121, i.e., the neck tube, to reciprocate in one body over a very small distance. Therefore, the equal opening area at the front and rear ends of the gap portion 121 contributes to smoothening the reciprocating motion of the air in the gap portion 121. This further increases the effect of the Helmholtz resonator.

In addition, the inner tubular case portion 7 according to the present preferred embodiment further includes a plurality of partitioning portions 74. Each partitioning portion 74 is a plate-shaped portion arranged to extend from a rear end to a front end of the silencing space 91. A radially outer edge of the partitioning portion 74 is arranged to be in contact with the inside surface of the discharge case portion 3. The opening portion 121 is arranged circumferentially between a pair of adjacent ones of the partitioning portions 74. This structure makes it easy to vary the volume of the silencing space 91 by adjusting the circumferential positions of the partitioning portions 74. Note that the partitioning portions may alternatively be defined in the inside surface of the discharge case portion. In this case, a radially inner edge of each partitioning portion is arranged to be in contact with the outside surface of the inner tubular case portion. Also note that the partitioning portions may alternatively be members separate from both the inner tubular case portion and the discharge case portion.

While an exemplary preferred embodiment of the present invention has been described above, it will be understood that the present invention is not limited to the above-described preferred embodiment.

Figure 6:
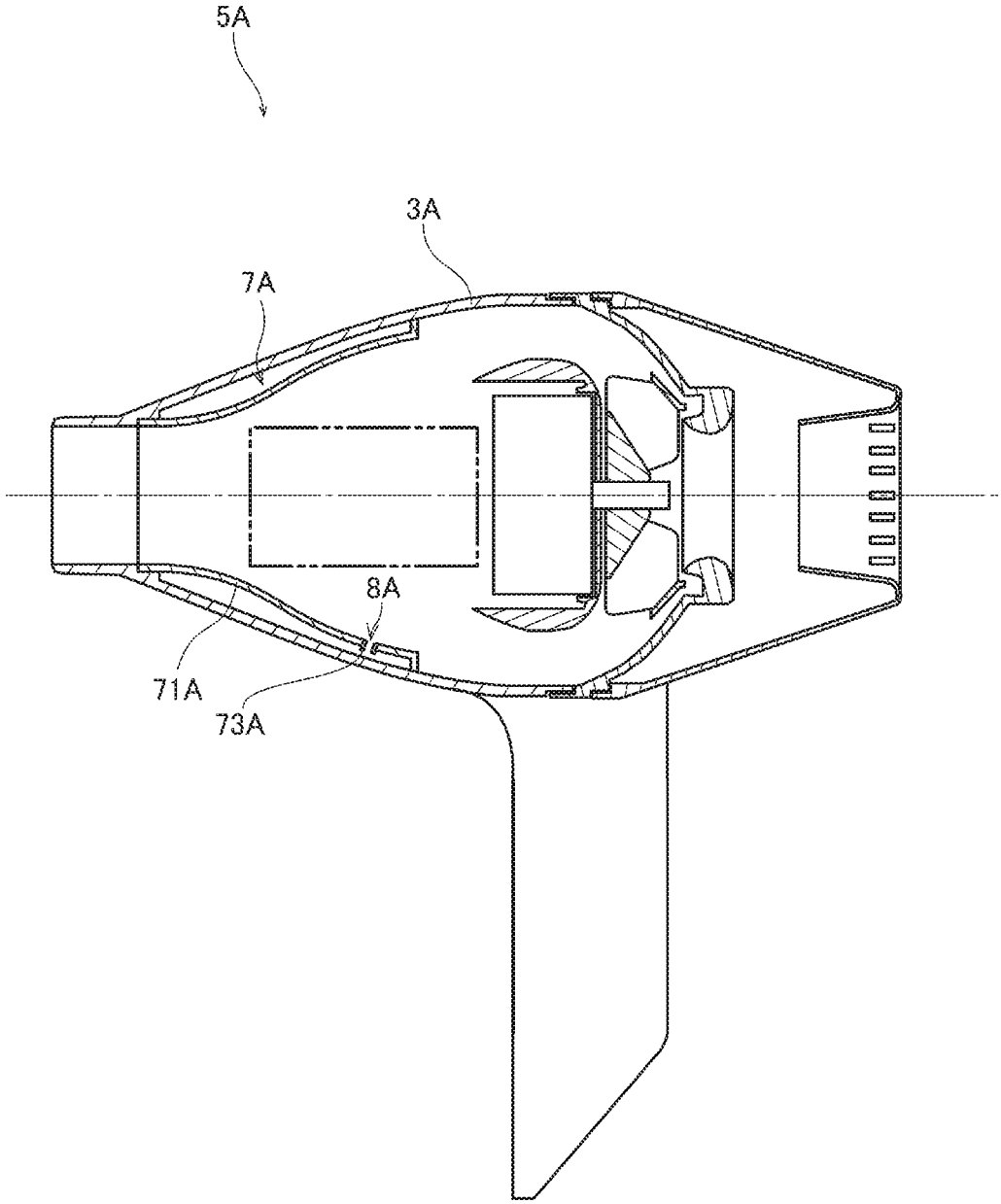
FIG. 6 is a vertical cross-sectional view of a hair dryer according to a modification of the above preferred embodiment of the present invention.

FIG. 6 is a vertical cross-sectional view of a hair dryer 5A according to a modification of the above-described preferred embodiment. The hair dryer 5A illustrated in FIG. 6 is different in structure from the hair dryer 5 according to the above-described preferred embodiment in the position and shape of the opening portion and the shape of the side wall portions. The hair dryer 5A is otherwise similar in structure to the hair dryer 5 according to the above-described preferred embodiment. An opening portion 8A according to the modification illustrated in FIG. 6 is a through hole passing through a tubular portion 71A of an inner tubular case portion 7A in a radial direction. The inner tubular case portion 7A includes a second side wall portion 73A arranged to extend from at least a portion of an edge of the opening portion 8A toward an inside surface of a discharge case portion 3A. According to the modification illustrated in FIG. 6, it is easy to arrange the opening portion 8A at an antinode of a sound wave of noise to be silenced. This contributes to increasing an effect of noise reduction by a Helmholtz resonator.

Figure 7:
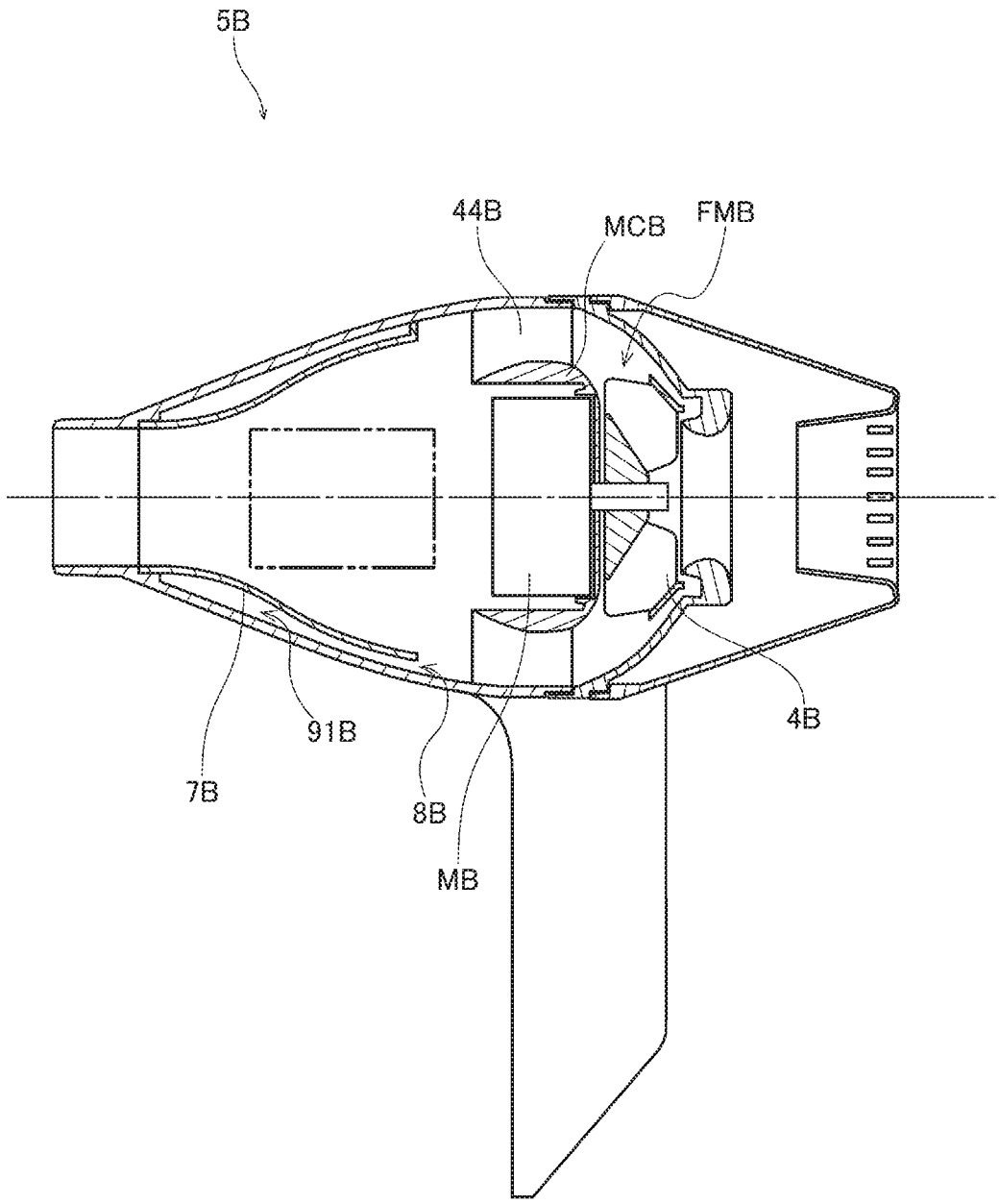
FIG. 7 is a vertical cross-sectional view of a hair dryer according to a modification of the above preferred embodiment of the present invention.

FIG. 7 is a vertical cross-sectional view of a hair dryer 5B according to a modification of the above-described preferred embodiment. The hair dryer 5B illustrated in FIG. 7 is different in structure from the hair dryer 5 according to the above-described preferred embodiment in that stationary vanes 44B are provided. According to the modification illustrated in FIG. 7, a motor case MCB of a fan motor FMB includes a plurality of stationary vanes 44B. The stationary vanes 44B are arranged in the circumferential direction between the motor case MCB and a discharge case portion 3B. An air flow caused by rotation of an impeller 4B passes forward between the stationary vanes 44B.

In addition, according to the modification illustrated in FIG. 7, inner ends of the stationary vanes 44B are arranged radially inward of a rear end portion of an inner tubular case portion 7B. This reduces the likelihood that the air flow caused by the rotation of the impeller 4B will come into contact with an opening-end edge of the inner tubular case portion 7B. This contributes to preventing air from being directly blown into an opening portion 8B. This contributes to reducing eddies caused by an air flow caused by the impeller 4B striking the opening-end edge of the inner tubular case portion 7B. Thus, an effect of noise reduction by a silencing space 91B is more easily achieved.

Figure 8:
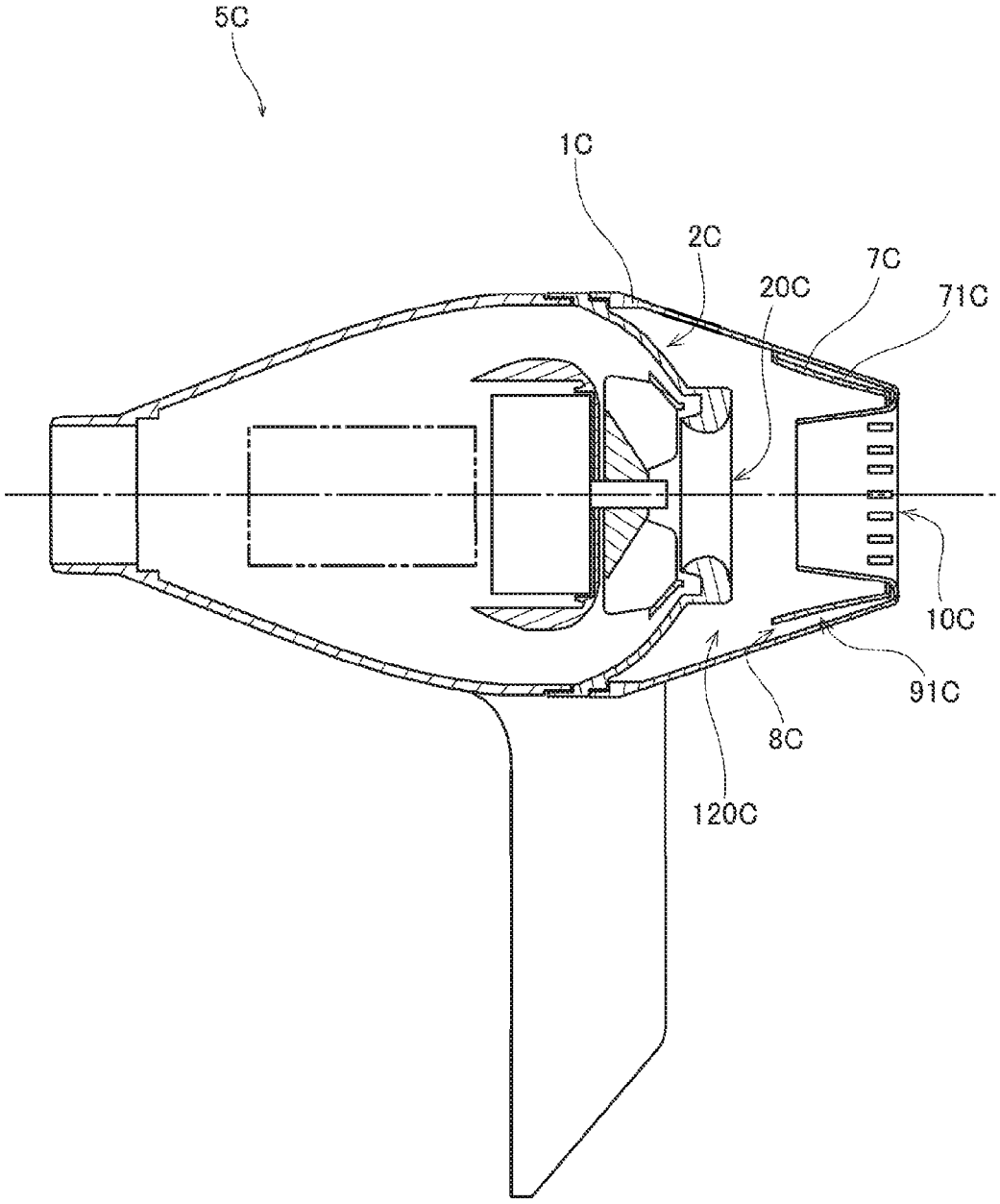
FIG. 8 is a vertical cross-sectional view of a hair dryer according to a modification of the above preferred embodiment of the present invention.

FIG. 8 is a vertical cross-sectional view of a hair dryer 5C according to a modification of the above-described preferred embodiment. The hair dryer 5C illustrated in FIG. 8 is different in structure from the hair dryer 5 according to the above-described preferred embodiment in that an inner tubular case portion 7C to define a Helmholtz resonator is arranged inside of an intake case portion 1C. In the hair dryer 5C illustrated in FIG. 8, an expansion chamber 120C is defined between the intake case portion 1C and an admission case portion 2C. The expansion chamber 120C is arranged radially outward of an air inlet 10C and an admission inlet 20C. In addition, the inner tubular case portion 7C is accommodated inside the intake case portion 1C. The inner tubular case portion 7C includes a tubular portion 71C arranged to extend along an inside surface of the intake case portion 1C. In addition, a silencing space 91C is defined between the inside surface of the intake case portion 1C and an outside surface of the inner tubular case portion 7C. Further, an opening portion 8C arranged radially inside of the intake case portion 1C to join the silencing space 91C and the expansion chamber 120C to each other is defined in the inner tubular case portion 7C.

In the above-described manner, a Helmholtz resonator may be provided inside of the intake case portion 1C. In particular, in the expansion chamber 120C, fluctuations in air pressure constantly occur because of air sucked in through the air inlet 10C. In the hair dryer 5C, the opening portion 8C and the silencing space 91C combine to act as the Helmholtz resonator to absorb the fluctuations in air pressure in the expansion chamber 120C. In addition, noise at a specific frequency in the expansion chamber 120C can be reduced by appropriately designing the cross-sectional area of the opening portion 8C and the volume of the silencing space 91C. Note that Helmholtz resonators may be provided both inside the intake case portion and inside the discharge case portion.

Figure 9:
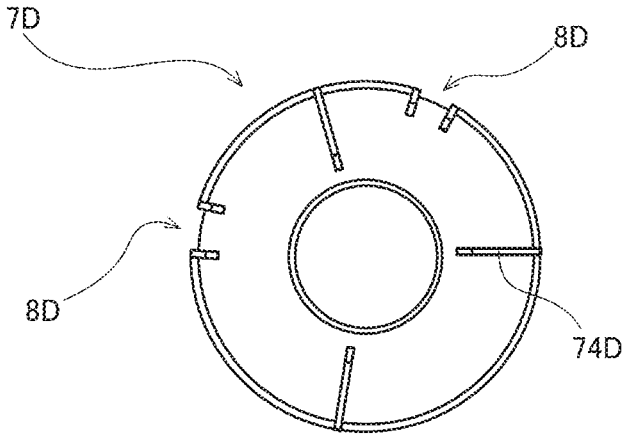
FIG. 9 is a front view of an inner tubular case portion according to a modification of the above preferred embodiment of the present invention.

FIG. 9 is a front view of an inner tubular case portion 7D according to a modification of the above-described preferred embodiment. The inner tubular case portion 7D illustrated in FIG. 9 is different in structure from the inner tubular case portion 7 according to the above-described preferred embodiment in that a plurality of opening portions 8D are provided. Each of the opening portions 8D is arranged circumferentially between a pair of adjacent partitioning portions 74D. A plurality of silencing spaces can thus be defined. Moreover, the silencing spaces may be arranged to have different volumes to provide a plurality of Helmholtz resonators to simultaneously reduce noise at different frequencies.

In the above-described preferred embodiment, the gap portion 121 is defined between the two first side wall portions 72, the inside surface of the discharge case portion 3, and the outside surface of the inner tubular case portion 7. However, one of the first side wall portions defining the gap portion 121 may be a partitioning portion arranged to extend from the rear end to the front end of the silencing space. In other words, the gap portion 121 may be defined between the first side wall portion, the partitioning portion, the inside surface of the discharge case portion, and the outside surface of the inner tubular case portion.

Also, in the above-described preferred embodiment, the impeller guard portion is provided in the air inlet. Note, however, that the impeller guard portion may alternatively be provided in the admission inlet. This makes it easier to clean the interior space of the body case.

Also note that various modifications can be made to the hair dryer without departing from the scope and spirit of the present invention. For example, a fan motor including an impeller and a motor may be arranged more forward than the fan motor in FIG. 1.

Also note that the detailed shape of any member of the hair dryer may be different from the shape thereof as illustrated in the accompanying drawings of the present application. Also note that features of the above-described preferred embodiment and the modifications thereof may be combined appropriately as long as no conflict arises.

Preferred embodiments of the present invention are applicable to, for example, hair dryers.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hair dryer that sends air forward along a central axis extending in a direction from a front of the hair dryer to a rear of the haft dryer, the hair dryer comprising:

a fan motor;

a heater; and a hollow tubular body case that covers the fan motor and the heater, and that extends in the direction around the central axis to define an interior space; wherein the fan motor includes:

an impeller that rotates about the central axis; and a motor that drives the impeller;

the body case includes:

an intake case portion including an air inlet; and a discharge case portion including an air outlet;

the body case includes an inner tubular case portion accommodated therein adjacent to the air outlet, the inner tubular case portion extending along an inside surface of the body case;

the inside surface of the body case and the inner tubular case portion directly contact one another about an entire circumference to define an enclosed silencing space therebetween; and an opening portion is defined: (i) between the inner tubular case portion and the body case, or (ii) in the inner tubular case portion, the opening portion joins the silencing space and the interior space.

2. The hair dryer according to claim 1, wherein the discharge case portion defines a discharge space inside thereof;

the inner tubular case portion is accommodated inside the discharge case portion and includes a tubular portion that extends in an axial direction along an inside surface of the discharge case portion;

the silencing space is defined between the inside surface of the discharge case portion and the inner tubular case portion; and the opening portion joins the discharge space and the silencing space to each other.

3. The hair dryer according to claim 2, wherein the discharge case portion includes:

a case tubular portion that decreases in an inside diameter in a forward direction; and a nozzle portion that extends forward from a front end of the case tubular portion; and the tubular portion is radially inside of the case tubular portion.

4. The hair dryer according to claim 3, wherein an area of a cross section of the silencing space perpendicular to the axial direction increases in the forward direction.

5. The hair dryer according to claim 3, wherein the discharge case portion includes, at an inside surface of a portion of the discharge case portion at a junction between the case tubular portion and the nozzle portion, a shoulder portion adjacent to a front end of the tubular portion and in axial and radial contact with the inner tubular case portion; and an outside surface of a front end portion of the inner tubular case portion is fitted to an inside surface of the shoulder portion.

6. The hair dryer according to claim 5, wherein an inner circumferential surface of the nozzle portion and an inner circumferential surface of the tubular portion have a same diameter at a radially inner end of the shoulder portion.

7. The hair dryer according to claim 2, wherein a rear end portion of the inner tubular case portion is forward of the impeller.

8. The hair dryer according to claim 2, wherein a rear end portion of the inner tubular case portion is radially outward of the impeller.

9. The hair dryer according to claim 2, wherein the inner tubular case portion includes an annular flange portion that extends from a rear end portion thereof toward the inside surface of the discharge case portion; and the opening portion passes through the flange portion in the axial direction.

10. The hair dryer according to claim 9, wherein an outside surface of the annular flange portion is in contact with the inside surface of the discharge case portion over an entire circumference except at the opening portion.

11. The hair dryer according to claim 9, wherein first side wall portions that extend forward from both circumferential sides of the opening portion are provided between the inside surface of the discharge case portion and an outside surface of the inner tubular case portion; and the first side wall portions, the inside surface of the discharge case portion, and the outside surface of the inner tubular case portion together define a gap portion therebetween.

12. The hair dryer according to claim 11, wherein one of the first side wall portions defining the gap portion is in contact with the outside surface of the inner tubular case portion and the inside surface of the discharge case portion, and extends from a rear end to a front end of the silencing space.

13. The hair dryer according to claim 12, wherein the gap portion has an equal opening area at a rear end and a front end thereof.

14. The hair dryer according to claim 11, wherein each first side wall portion is plate-shaped and extends from the outside surface of the inner tubular case portion toward the inside surface of the discharge case portion in parallel with one plane including the central axis.

15. The hair dryer according to claim 2, wherein the opening portion passes through the tubular portion in a radial direction; and the inner tubular case portion includes a second side wall portion that extends from at least a portion of an edge of the opening portion toward the inside surface of the discharge case portion.

16. The hair dryer according to claim 2, wherein a plurality of partitioning portions are provided between the inner tubular case portion and the discharge case portion;

each partitioning portion is in contact with both an outside surface of the inner tubular case portion and the inside surface of the discharge case portion, and extends from a rear end to a front end of the silencing space; and the opening portion is between a pair of adjacent ones of the partitioning portions.

17. The hair dryer according to claim 2, wherein the fan motor further includes a motor case that fixes the fan motor to the body case;

the motor case includes a plurality of stationary vanes; and inner ends of the stationary vanes are radially inward of a rear end portion of the inner tubular case portion.

18. The hair dryer according to claim 1, wherein the body case further includes an admission case portion between the air inlet and the air outlet, and including an admission inlet passing therethrough in an axial direction;

the intake case portion and the admission case portion together define an expansion chamber between the air inlet and the admission inlet and radially outward of the air inlet and the admission inlet;

the inner tubular case portion is accommodated inside the intake case portion, and extends along an inside surface of the intake case portion;

the silencing space is defined between an inside surface of the intake case portion and the inner tubular case portion; and the opening portion joins the expansion chamber and the silencing space to each other.

19. The hair dryer according to claim 1, wherein a volume of the silencing space corresponds to a predetermined target frequency range of a Helmholtz resonator.

* * * * *